US006231383B1

(12) United States Patent
Hwang

(10) Patent No.: US 6,231,383 B1
(45) Date of Patent: May 15, 2001

(54) PANEL MOUNT ELECTRICAL CONNECTOR ASSEMBLY WITH IMPROVED SECUREMENT

(75) Inventor: Jenq-Yih Hwang, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/449,198

(22) Filed: Nov. 24, 1999

(51) Int. Cl.[7] ..... H01R 13/74
(52) U.S. Cl. ..... 439/545; 439/564
(58) Field of Search ..... 439/545, 564, 439/939, 76.1

(56) References Cited

U.S. PATENT DOCUMENTS 5,306,175 * 4/1994 Swanstrom ..... 439/564
5,320,554 * 6/1994 Freer et al. ..... 439/545

* cited by examiner

*Primary Examiner*—Gary F. Paumen
(74) *Attorney, Agent, or Firm*—Wei Te Chung

(57) ABSTRACT

A panel mount electrical connector assembly for mounting on a panel of an instrument, includes a movable built-in screw with a front head, a traditional connector unit, and an insulative outer housing. A fixture securement with a fixture head is integrally formed in front of the outer housing. The panel is defined with a plurality of cutouts each divided into a wide region and a narrow region communicated with each other. In assembly, the heads of the screw and the fixture securement of the connector assembly removably enter through the wide regions of the corresponding cutouts of the panel, firstly. Then, the heads are successively moved along but restricted from being removed out the narrow regions of the same cutouts thereby accurately driving only the screw in for conveniently and speedy securing the electrical connector assembly to the panel.

1 Claim, 4 Drawing Sheets

PANEL MOUNT ELECTRICAL CONNECTOR ASSEMBLY WITH IMPROVED SECUREMENT

BACKGROUND OF THE INVENTION

1. Field of the Invention

The present invention relates to an electrical connector assembly, and particularity to a panel mount electrical connector assembly for securing to a panel of an electric instrument.

2. The Prior Art

In conventional connector assemblies mounted to a panel of an electric instrument like a computer chassis, a first type connector as introduced in U.S. Pat. Nos. 4,820,180, 4,988,308, 5,017,151, 5,049,092, 5,249,982, 5,514,000, 5,525,074, 5,575,673, 5,632,648, 5,766,041, 5,895,289, 5,931,688 and RE 34,430 presents the claw-like or sealed securement of the connector to the panel. However, the process of interference-fitting the connector through an opening defined on the panel may have the claw/seal permanently deformed in fitting dimension. The incorrect/change of fitting tolerance may loose the securement of the connector to the panel. A mating action of an external connector may forcedly push the connector assembly out of the panel, consequently.

A second type connector as introduced in U.S. Pat. Nos. 4,678,259, 5,228,865, 5,254,010, 5,709,569, 5,772,471, 5,924,877, and Des. 415,106 presents the direct-screwed securement of the connector to the panel for enhancement of the retention. However, the manual pre-alignment among several different screwed holes defined on the connector assembly, the mating connector and the panel, and the usage of the external and separate screws easily causes the securement of the connector inconvenient and time-consuming.

A third type connector as introduced in U.S. Pat. No. 5,766,035 presents two lugs 8*a*, 8*b* for pre-alignment of the connector with the panel before being screwed thereto. However, it is anticipated that its corresponding mating connector must be a specific one additionally installed with two screws. Other common mating connectors without additional screws are not suitable for the third type connector. Also, the screws solely driven inside the mating connector are possibly lost in delivery because of the removability of the screws from the mating connector.

This invention is a variation of the invention of copending U.S. patent application Ser. No. 09/449,108 filed Nov. 24, 1999 and with the same assignee and inventor as the instant application, entitled "PANEL MOUNT ELECTRICAL CONNECTOR ASSEMBLY", which introduces a pair of specific screws movable built in an panel mount electrical connector assembly enclosing a USB (Universal Serial Bus) connector for firmly and speedily screwing the connector assembly to the panel.

SUMMARY OF THE INVENTION

Accordingly, one object of the present invention is to provide a panel mount electrical connector assembly having a fixture securement aiding a specific screw for easily, firmly and speedily securing the electrical connector to a panel of an electrical instrument like a computer chassis.

Another object of the present invention is to provide the panel mount electrical connector assembly with the fixture securement capable to save the usage of an additional screw and to be laborsaving in assembly, which only one screw have to be driven in.

To fulfill the above mentioned objects, according to the preferred embodiment of the present invention, a panel mount electrical connector assembly mounted on a panel of an instrument for coupling with a mating connector, includes an insulative outermost housing, a movable built-in screw, and a traditional connector unit linking with a bunch of cables.

A fixture securement integrally formed with the outer housing, including a neck and a fixture head formed at a distal end of the neck and dimensioned larger than the neck in width.

The panel consists of opposite front and rear surfaces, a first cutout and a second cutout respectively defined through both surfaces of the panel. Each of the cutouts is divided into a wide region and a narrow region communicated and dimensioned with regard to the wide region.

In assembly, said heads of the fixture securement and the screw are respectively moved to the wide regions of the corresponding cutouts of the panel and enter through the wide regions of the cutouts. Then, the heads are through the same cutouts and moved to the narrow regions of the same cutouts but restricted by the cutouts from being removed out of the cutouts thereby accurately driving only the screw in for easily and speedily securing the connector assembly to the panel.

DETAILED DESCRIPTION OF THE PREFERRED EMBODIMENTS

Detailed reference will now be made to the preferred embodiment of the present invention.

Figure 1:
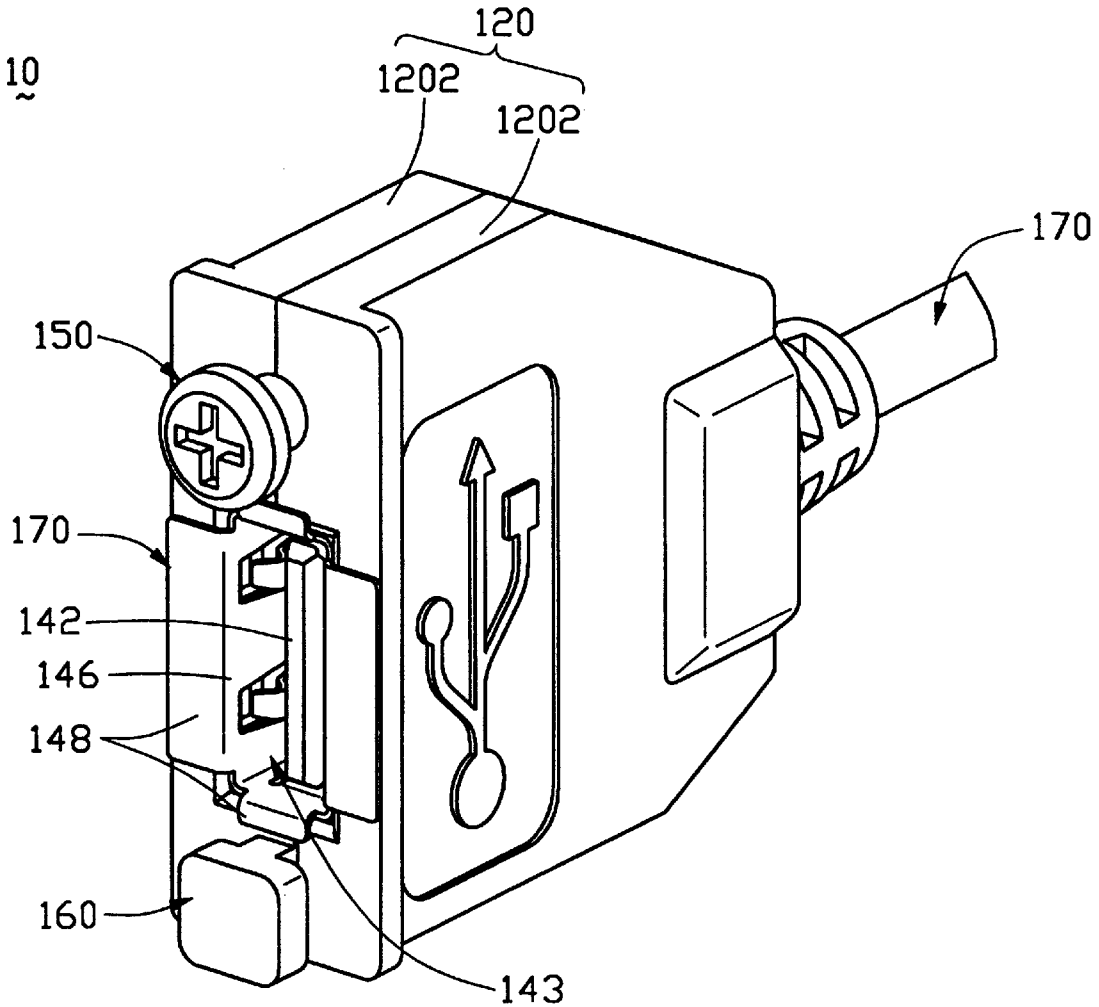
FIG. 1 is a front perspective view of a panel mount electrical connector assembly in accordance with a preferred embodiment of the present invention.
Figure 2:
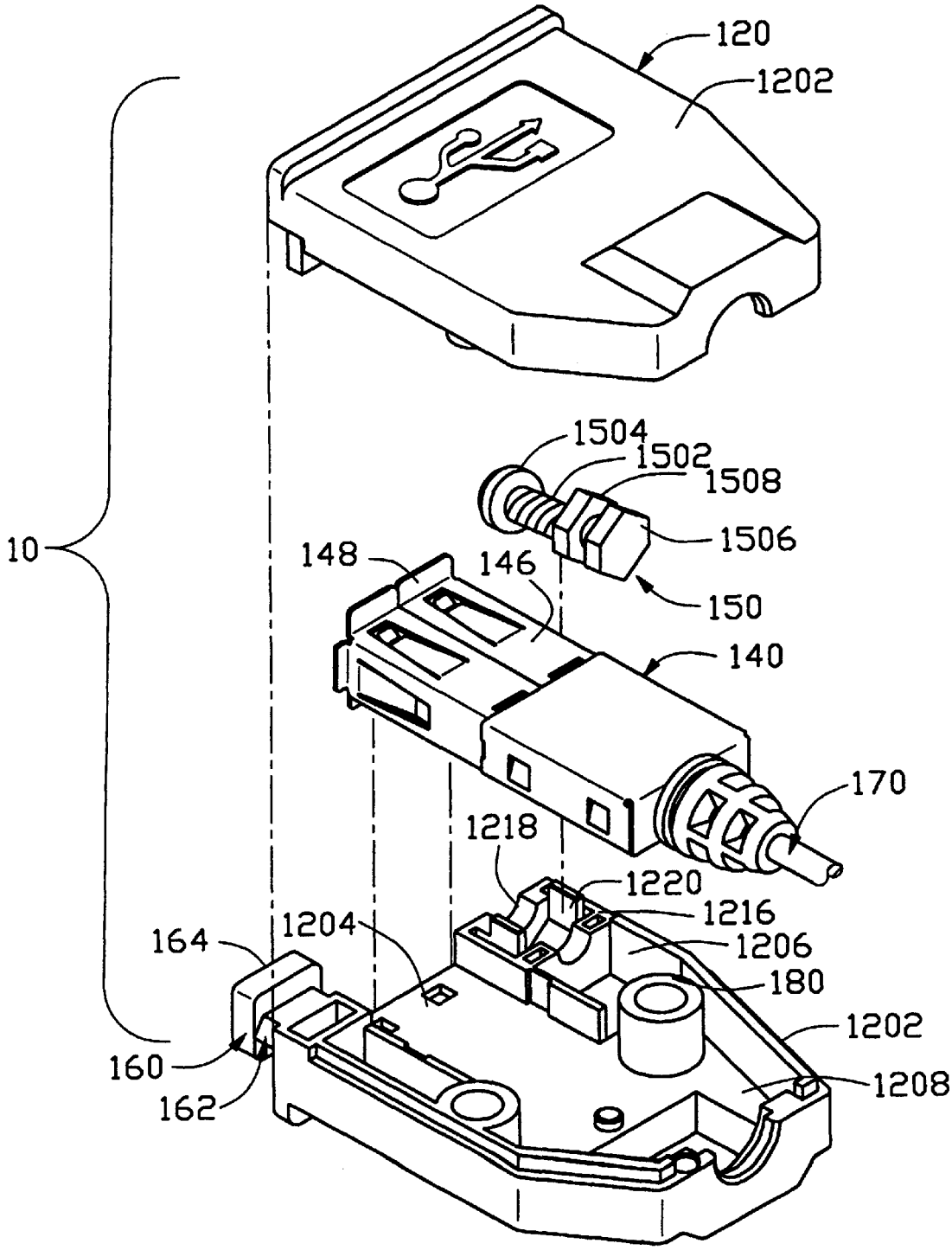
FIG. 2 is an exploded view of the panel mount electrical connector assembly shown in FIG. 1.

Referring to FIGS. 1 & 2, a panel mount electrical connector assembly 10 in accordance with the present invention for coupling with a mating connector (not shown), includes an insulative outermost housing 120, a connector unit 140 with a mating opening 143 therein, a specific screws 150, and a bunch of cables 170. Meanwhile, the connector unit 140 is optionally designated to be a standard connector like an USB (Universal serial Bus) connector, which is capable of coupling alone with the mating connector beside used in the electrical connector assembly 10. Such a standard connector unit 140 commonly has an inner insulative housing 142, a plurality of contacts (not shown) disposed within the inner housing 142, and an inner conductive shell 146 used to shield around the outside of the inner housing 142. The inner shell 146 further integrally forms a plurality of grounding tabs 148 extending around a mating surface of the connector unit 140. As shown in FIG. 2, the connector unit 140 pre-links with the cables 170.

As shown in FIG. 2, the outer insulative housing 120 is defined with a upper and lower covers 1202 which are similar to each other expect a pair of complementary posts 180 thereof for convenience of fabrication. Each of the cover 1202 as shown in FIG. 2 forms a platform 1204 adjacent a front end thereof for reception of the connector unit 140. A first passageway 1206 is integrally located at one of opposite sides of the platform 1204, along a front-to-rear direction for reception of the screws 150. A pit 1208 communicates a rear portion of the platform 1204 for reception of the cables 170 in part. A stop portion 1216 is integrally swelled in front of each of the first passageways 1206 in position adjacent to the front end of the same cover 1202. A second passageway 1218 defined above each stop portion 1216 is dimensioned smaller than the corresponding first passageway 1218. A deep cave 1220 is defined at central region of each of the stop portion 1216 to cut the corresponding second passageway 1218 off. A securement 160 is integrally formed on opposite side of the platform 1204 of one of the covers like the lower cover 1202, including a neck 162 extending beyond the front end of the cover 1202 in a predetermined distance. A fixture head 164 is formed at a distal end of the neck 162 and dimensioned larger than the neck 162 in width. It is noted that the securement 160 is capable to be selectively configured on either one of the covers 1202 or both covers 1202 in halves.

The specific screw 150 is fabricated to have a threaded shaft 1502 and two heads 1504, 1506 wider than the shaft 1502, located at opposite ends of the threaded shaft 1502. A fixture portion 1508 with an inner thread like a nut is screwed on the threaded shaft 1502 but restricted between the heads 1504, 1506 of the screw 150. Optionally, the rear head 1506 is shaped by soldering another nut to the rear end of the screw 150, or by a stamping process to deform the rear end of the screw 150.

In assembly of the screw 150 within one of the covers 1202 of the outer housing 120, the front head 1504 of the screw 150 is exposed out of the cover 1202 for being driven. And, the rear head 1506 is movably restricted within the corresponding first passageway 1206 by the stop portion 1216 from removal of the entire screw 150 out of the outer housing 120. The fixture portion 1508 is fixedly located within the cave 1220 of the outer housing 120 thereby cooperating with the threaded shaft of the screw 150 to adjustably move the screw 150 in/out. Therefore, the screw 150 is movably built in the outer housing 120 of the connector assembly 10 without possibility of loss. Then, the sub-assembled lower cover 1202 and the upper cover 1202 are combined, as the result shown in FIG. 1, where the connector unit 140 is fully enclosed almost except the grounding tabs 148 for electrical contact with a panel 20 shown in FIG. 3. The efficient retention between both covers 1202 is optionally built by an ultrasonic welding.

Figure 3:
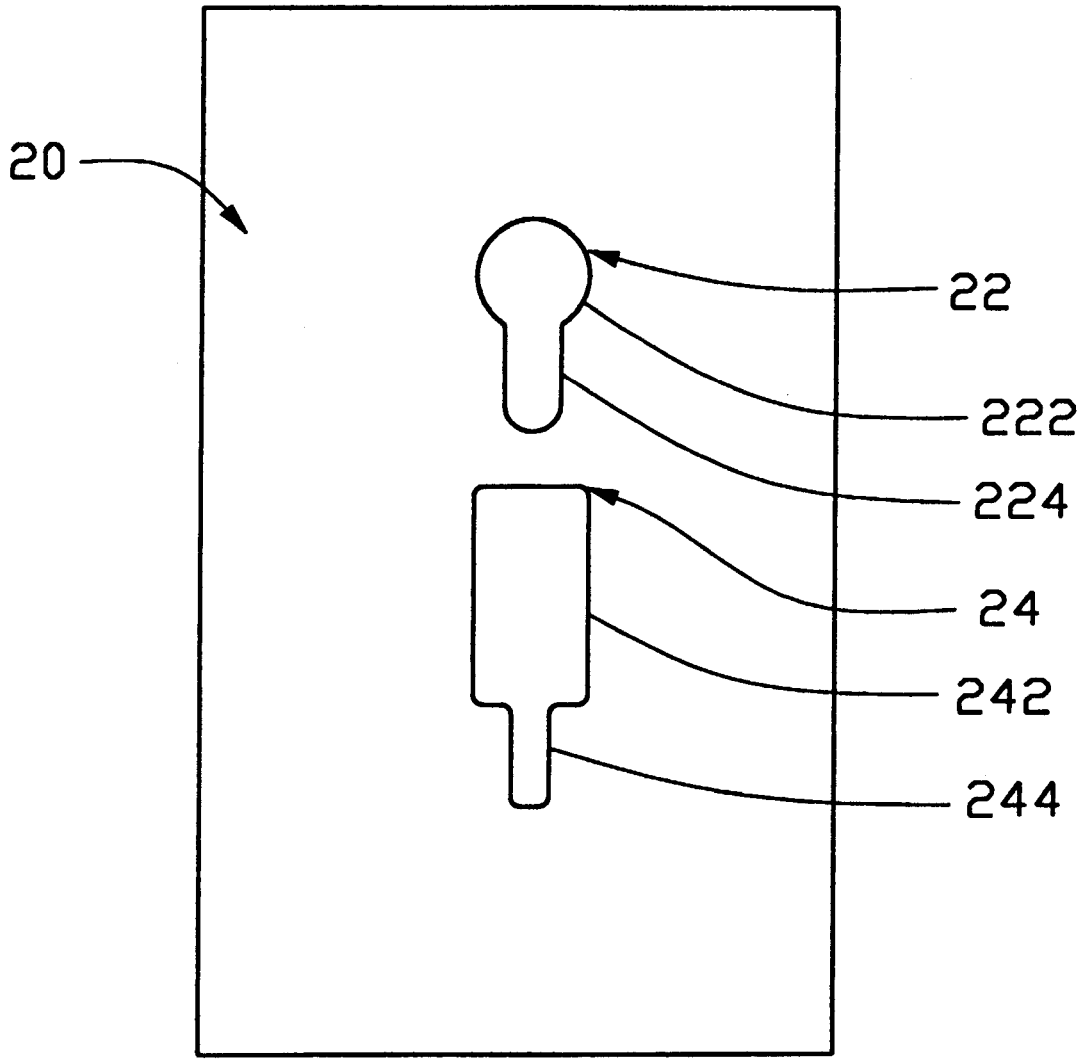
FIG. 3 is a front view of a panel for used with the panel mount electrical connector assembly of FIG. 1.

The panel 20 shown in FIG. 3 serves for an electrical instrument like a computer, and consists of opposite front and rear surfaces. A first cutout 22 and a second cutout 24 are respectively defined through both surfaces of the panel 20, each is divided into a wide region 222, 242 and a narrow region 224, 244 below communicated and dimensioned with regard to the wide region 222, 242. Beside, the wider region 242 of the second cutout 24 is dimensioned sufficient to permit entrance/removal of the mating connector for coupling with the electrical connector assembly 10.

Figure 4:
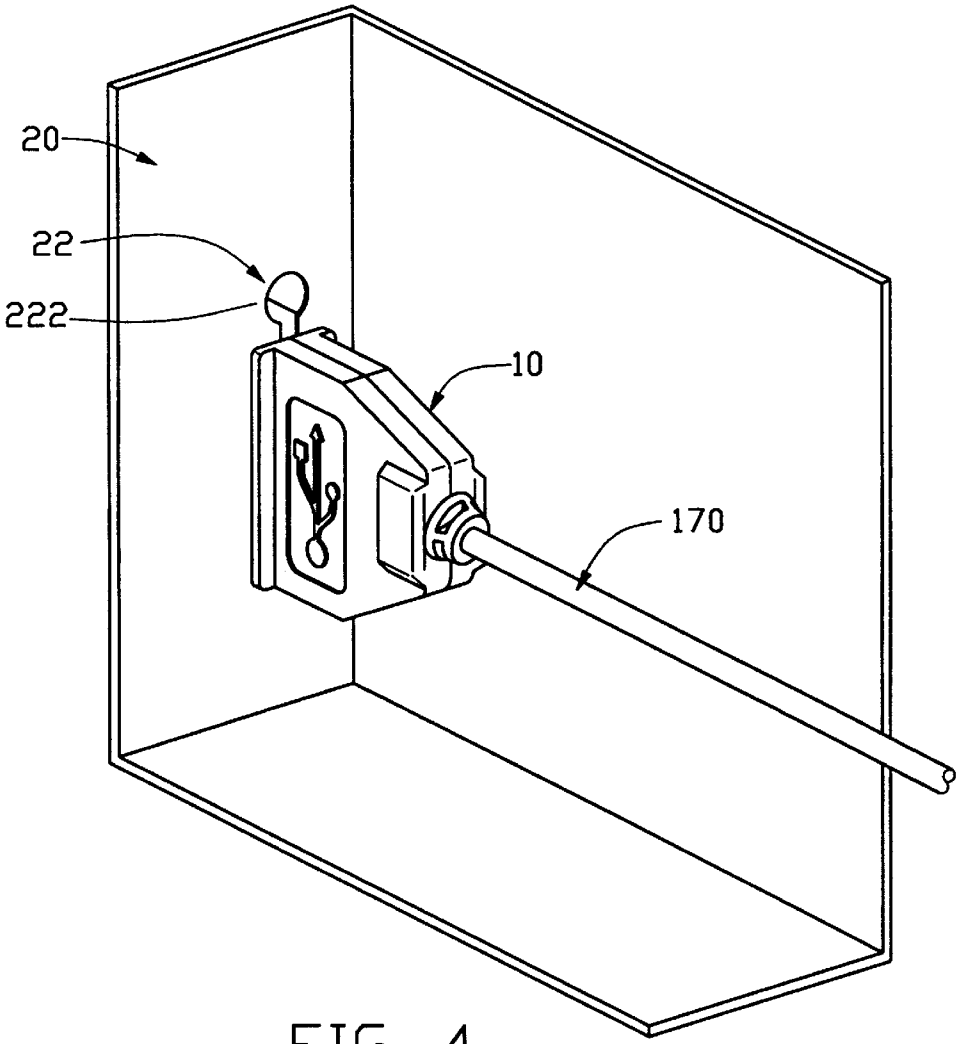
FIG. 4 is a front perspective view of the panel mount electrical connector assembly of FIG. 1, which is secured to the panel.

In assembly of the electrical connector assembly 10 with the panel 20, the front head 1504 of the specific screw 150 and the fixture head 164 of the securement 160 are firstly moved to removably enter through the wide regions 222, 242 of the corresponding cutouts 22, 24, respectively whereby the front head 1504 and the fixture head 164 are exposed outside the panel 20 in opposition to the surface where the electrical connector assembly 10 is disposed. Then, the front head 1504 and the fixture head 164 are successively moved downwardly along but restricted from being removed out the narrow regions 224, 244 of the corresponding cutouts 22, 24, as being a hooking relationship. This is because the front head 1504 and the fixture head 164 are dimensioned larger than the narrow regions 224, 244 of the corresponding cutouts 22, 24 in width but the threaded shaft 1502 and the neck 162 are dimensioned smaller or equal to the narrow regions 224, 244. Accordingly, any one user can conveniently and speedy screw the electrical connector assembly to the panel as long as driving the screw 150 in, as the result shown in FIG. 4. Meanwhile, the mating surface of the connector unit 140 of the connector assembly 10 is aligned with the wide region 242 of the second cutout 24 for coupling with the mating connector. For better alignment of the screw 150 with the cutout 22 before being driven in, the interval from the fixture head 164 of the securement 160 to the front end of the corresponding cover 1202, as the length of the neck 162, is optionally equal to the thickness of the panel 20.

In comparison with the above-mentioned prior arts, the design of the fixture securement 160 in accordance with the preferred embodiment of the present invention is cable to replace and save another additional screw, and to be labor-saving in assembly, which only one screw 150 have to be driven in.

While the present invention has been described with reference to the specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

I claim:

1. An electrical connector assembly for coupling with a mating connector, mounted on a panel of an instrument having a plurality of cutouts, comprising:

a connector unit for electrical contact with the mating connector, receiving a plurality of contacts therein;

a bunch of cables electrically connected with the contacts of the connector unit;

an outer insulative housing enclosing the connector unit; and a screw movably fixed in the outer housing and having a front head exposed outside the housing; and a fixture securement fixedly located in front of the outer housing and having a fixture head at a distal end thereof wherein said heads of the fixture securement and the screw respectively enter through the cutouts, and are and moved to a second region of each of the cutouts, so that all of the heads are respectively restricted by the second regions of the corresponding cutouts from being removed out of the cutouts and the screw is screwed down to the panel;

wherein the heads of the fixture securement and the screw are dimensioned smaller than or equal to the first regions of the corresponding cutouts but larger than the second regions of the same cutouts in width;

wherein the fixture securement further has a neck formed between the fixture head and the housing and dimensioned smaller than the fixture head in width.

* * * * *